US009157131B2

(12) United States Patent
Zou et al.

(10) Patent No.: US 9,157,131 B2
(45) Date of Patent: Oct. 13, 2015

(54) HIGH CARBON CONTENT AND HIGH STRENGTH HEAT-TREATED STEEL RAIL AND METHOD FOR PRODUCING THE SAME

(75) Inventors: Ming Zou, Panzhihua (CN); Dongsheng Mei, Chengdu (CN); Quan Xu, Chengdu (CN); Yong Deng, Panzhihua (CN); Hua Guo, Chengdu (CN); Ming Liu, Chengdu (CN); Li Tang, Panzhihua (CN); Yun Zhao, Panzhihua (CN); Gongming Tao, Panzhihua (CN)

(73) Assignees: PANGANG GROUP CO., LTD., Panzhihua (CN); PANGANG GROUP RESEARCH INSTITUTE CO., LTD., Chengdu (CN); PANGANG GROUP PANZHIHUA STEEL & VANADIUM CO., LTD., Panzhihua (CN)

( * ) Notice: Subject to any disclaimer, the term of this patent is extended or adjusted under 35 U.S.C. 154(b) by 841 days.

(21) Appl. No.: 12/953,382

(22) Filed: Nov. 23, 2010

(65) Prior Publication Data

US 2011/0253268 A1 Oct. 20, 2011

(30) Foreign Application Priority Data

Apr. 16, 2010 (CN) ..... 2010 1 0148333

(51) Int. Cl.

| | |
|---|---|
| ***C21D 9/04*** | (2006.01) |
| ***C22C 38/18*** | (2006.01) |
| ***C21D 1/667*** | (2006.01) |

(Continued)

(52) U.S. Cl.

CPC *C21D 9/04* (2013.01); *C21D 1/667* (2013.01); *C22C 38/001* (2013.01); *C22C 38/02* (2013.01); *C22C 38/04* (2013.01); *C22C 38/06* (2013.01); *C22C 38/24* (2013.01); *C22C 38/28* (2013.01); *B21B 1/085* (2013.01); *C21D 2211/004* (2013.01); *C21D 2211/009* (2013.01); *C21D 2221/00* (2013.01); *C21D 2221/02* (2013.01)

(58) Field of Classification Search

USPC ..... 148/581, 569, 332, 333, 334, 335, 331
IPC ..... B21B 1/085; C21D 1/667,2211/004, C21D 2211/009, 2221/00
See application file for complete search history.

(56) References Cited

U.S. PATENT DOCUMENTS

| | | | | |
|---|---|---|---|---|
| 4,933,024 | A * | 6/1990 | Fukuda et al. | 148/584 |
| 2003/0192625 | A1 * | 10/2003 | Cordova | 148/320 |
| 2004/0187981 | A1 * | 9/2004 | Ueda et al. | 148/584 |

FOREIGN PATENT DOCUMENTS

| | | | |
|---|---|---|---|
| JP | 06279927 | A * | 10/1994 |
| JP | 07026348 | A * | 1/1995 |

(Continued)

*Primary Examiner* — Sikyin Ip
(74) *Attorney, Agent, or Firm* — Matthias Scholl P.C.; Matthias Scholl

(57) ABSTRACT

A high carbon content and high strength heat-treated steel rail including by weight 0.80-1.20% carbon, 0.20-1.20% silicon, 0.20-1.60% manganese, 0.15-1.20% chromium, 0.01-0.20% vanadium, 0.002-0.050% titanium, less than or equal to 0.030% phosphorus, less than or equal to 0.030% sulfur, less than or equal to 0.010% aluminum, less than or equal to 0.0100% nitrogen, and iron. The steel rail has excellent wear resistance and plasticity and can satisfy the requirement for overloading. A method for producing the steal rail by heating a slab to a heating temperature, multi-pass rolling, and accelerated cooling, wherein a maximum heating temperature (° C.) of said slab is equal to 1,400 minus 100[% C], [% C] representing the carbon content (wt. %) of said slab multiplied by 100.

14 Claims, 4 Drawing Sheets

(51) Int. Cl.

| | |
|---|---|
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/24*** | (2006.01) |
| ***C22C 38/28*** | (2006.01) |
| *B21B 1/085* | (2006.01) |

(56) References Cited

FOREIGN PATENT DOCUMENTS

| | | | | |
|---|---|---|---|---|
| JP | 2000345296 | A | * | 12/2000 |
| JP | 2002030341 | A | * | 1/2002 |
| JP | 2003129180 | A | * | 5/2003 |

* cited by examiner

HIGH CARBON CONTENT AND HIGH STRENGTH HEAT-TREATED STEEL RAIL AND METHOD FOR PRODUCING THE SAME

CROSS-REFERENCE TO RELATED APPLICATIONS

Pursuant to 35 U.S.C. §119 and the Paris Convention Treaty, this application claims the benefit of Chinese Patent Application No. 201010148333.0 filed Apr. 16, 2010, the contents of which are incorporated herein by reference.

BACKGROUND OF THE INVENTION

1. Field of the Invention

The invention relates to the metallurgical field and, more particularly, to a high carbon content and high strength heat-treated steel rail with excellent wear resistance and plasticity as well as a method for producing the same.

2. Description of the Related Art

One of the effective methods for prolonging the service life of steel rails is to improve the strength thereof. Pearlite, tempered martensite, and bainite are common structures for producing steel rails, among which pearlite structures are widely used due to good wear resistance, a simple production process, their low cost, and stable properties. However, for a pure pearlitic steel rail, the strength thereof hardly exceeds 1,330 MPa and the surface hardness hardly exceeds 380 HB. That is to say, the rail strength has very limited room for improvement.

Carbon is an effective element for improving the wear resistance of steel rails. Improvements in the cementite content of lamellar pearlite can improve the wear resistance. It is well known in metallurgic sciences that when the carbon content of a steel exceeds 0.77%, a proeutectoid cementite (secondary cementite) first forms under equilibrium. However, if the cooling rate is accelerated during the transformation of steel from austenite structures to pearlite structures, even if the carbon content exceeds 0.77%, a pseudo-eutectoid pearlite forms rather than the proeutectoid cementite. With the acceleration of the cooling rate, the upper limit of the carbon content of the pseudo-eutectoid pearlite increases. In use, railheads generally wear to a depth of 20 mm. To ensure safe use of the rails, the carbon content of the steel rails must be enhanced so that the pearlite structures are distributed to a depth of at least 25 mm from the railhead surface.

Conventional methods for producing high strength heat-treated steel rails employ eutectoid steel with a carbon content of 0.60-0.82%. The high strength is achieved by generating fine pearlite structures. However, if the rails have a low carbon content, the density of the cementite structures in the steel is low, and the tensile strength is low, generally less than 1,330 MPa. Thus, the rails have a poor wear resistance and short service life.

In the prior art, methods for producing steel rails with good wear resistance make use of hypereutectoid steel with a carbon content of 0.85-1.40%. The good wear resistance is achieved by generating fine pearlite structures and increasing the cementite density in the pearlite lamella. However, the methods have the following disadvantages. First, the obtained steel rails still have a low strength, generally less than HB 380, and the tensile strength is generally less than 1,330 MPa. Second, because the pearlite structures are distributed to a depth of only 20 mm from the surface, phase segregation occurs. The proeutectoid cementite structures, therefore, precipitate, which deteriorates the rail properties and provides a source for fatigue cracks and brittle fractures. Third, conventional cooling rates are generally less than 10° C./s, usually 2-5° C./s. To improve the rail strength, a high cooling rate (5-15° C./s) is required, which would require the existing production lines to be updated, incurring a high investment. Finally, nitrogen is harmful for rail properties, but conventional methods have no way of reducing this harm.

As the carbon content increases, the plasticity and toughness of the rails decrease. Thus, compared with common pure pearlite structures, the hypereutectoid rails have a much lower plasticity and toughness, which means the rails may break when use in cold regions with temperatures below zero. Although the prior art discloses that plasticity and toughness may be enhanced by cooling different portions of the rails with different modes, the operation is complicated and has a high cost.

Thus, it is urgent to develop a high carbon content and high strength hot rolling steel rail with good wear resistance and plasticity and a method for producing the same.

SUMMARY OF THE INVENTION

In view of the above-described problems, it is one objective of the invention to provide a high carbon content and high strength heat-treated steel rail featuring excellent wear resistance and plasticity.

It is another objective of the invention to provide a method for producing a high carbon content and high strength heat-treated steel rail featuring excellent wear resistance and plasticity.

To achieve the above objectives, in accordance with one embodiment of the invention, there is provided a high carbon content and high strength heat-treated steel rail, the steel rail comprising by weight 0.80-1.20% carbon, 0.20-1.20% silicon, 0.20-1.60% manganese, 0.15-1.20% chromium, 0.01-0.20% vanadium, 0.002-0.050% titanium, less than or equal to 0.030% phosphorus, less than or equal to 0.030% sulfur, less than or equal to 0.010% aluminum, less than or equal to 0.0100% nitrogen, iron, and impurities. The steel rail has excellent wear resistance and plasticity. The tensile strength of the steel rail head is greater than or equal to 1,330 MPa, the elongation percentage of the steel rail is greater than or equal to 9%, the hardness of the steel rail head is greater than or equal to HB 380, the depth of the hardened layer is greater than or equal to 25 mm, and the thickness of the fine pearlite structures of the steel rail head is greater than or equal to a depth of 25 mm.

In a class of this embodiment, the steel rail comprises by weight 0.80-1.20% carbon, 0.20-1.20% silicon, 0.40-1.20% manganese, 0.15-0.60% chromium, 0.01-0.15% vanadium, 0.002-0.030% titanium, less than or equal to 0.030% phosphorus, less than or equal to 0.030% sulfur, less than or equal to 0.010% aluminum, less than or equal to 0.0100% nitrogen, iron, and impurities. The steel rail has excellent wear resistance and plasticity.

In a class of this embodiment, the steel rail further comprises by weight 0.01-0.50% molybdenum, 0.002-0.050% niobium, 0.10-1.00% nickel, 0.05-0.50% copper, and 0.002-0.050% rare earth metal, 0.0001-0.1000% zirconium, or a mixture thereof.

In a class of this embodiment, a total weight percent of Cr+1.5Mn+6Mo+4Nb in the steel rail is 1.0-2.5%.

In a class of this embodiment, when the nitrogen content of the steel rail is less than or equal to 0.0070%, the titanium content is 0.002-0.020%; when the nitrogen content of the steel rail exceeds 0.0071% but is less than or equal to 0.010%, the titanium content is 0.010-0.050%.

In accordance with another embodiment of the invention, there is provided a method for producing a high carbon content and high strength heat-treated steel rail comprising heating of a slab, applying multi-pass rolling, and applying accelerated cooling, wherein the maximum heating temperature (Tmax, ° C.) of the slab is equal to 1,400 minus 100[% C], wherein [% C] represents the carbon content (wt. %) of the slab multiplied by 100.

In a class of this embodiment, the heating temperature of the slab is greater than or equal to 1,050° C., and the maximum holding time (Hmax) (min) for the temperature is equal to 700 minus 260[% C], wherein [% C] represents the carbon content (wt. %) of the slab multiplied by 100.

In a class of this embodiment, during the process of multi-pass rolling, the reduction of the area during the final pass is 5-13%, and the finishing temperature is 850-980° C.

In a class of this embodiment, the residual heat temperature of hot-rolled steel rail is 680-900° C., and during cooling, the railhead and rail base are cooled, by spraying or by compressed air, to 400-500° C. with a cooling rate of 1.5-10° C./s, followed by cooling in ambient air.

Advantages of the invention are summarized below. The tensile strength of the steel rail head is greater than or equal to 1,330 MPa, the elongation percentage of the steel rail is greater than or equal to 9%, the hardness of the steel rail head is greater than or equal to HB 380, the depth of the hardened layer is greater than or equal to 25 mm, and the thickness of the fine pearlite structures of the steel rail head is greater than or equal to a depth of 25 mm from the surface. The steel rail has excellent wear resistance and plasticity and meets the requirements for overloading, conveying excellent potential. The elemental content, the temperature ranges, and the order of production steps are critical to obtaining these characteristics. The method of the invention is simple and easy to practice, and can be achieved using conventional production lines with simple adjustments to the heating temperature, temperature holding time, and finishing temperature.

BRIEF DESCRIPTION OF THE DRAWINGS

The invention is described hereinbelow with reference to the accompanying drawings, in which.

DETAILED DESCRIPTION OF THE EMBODIMENTS

Figure 1:
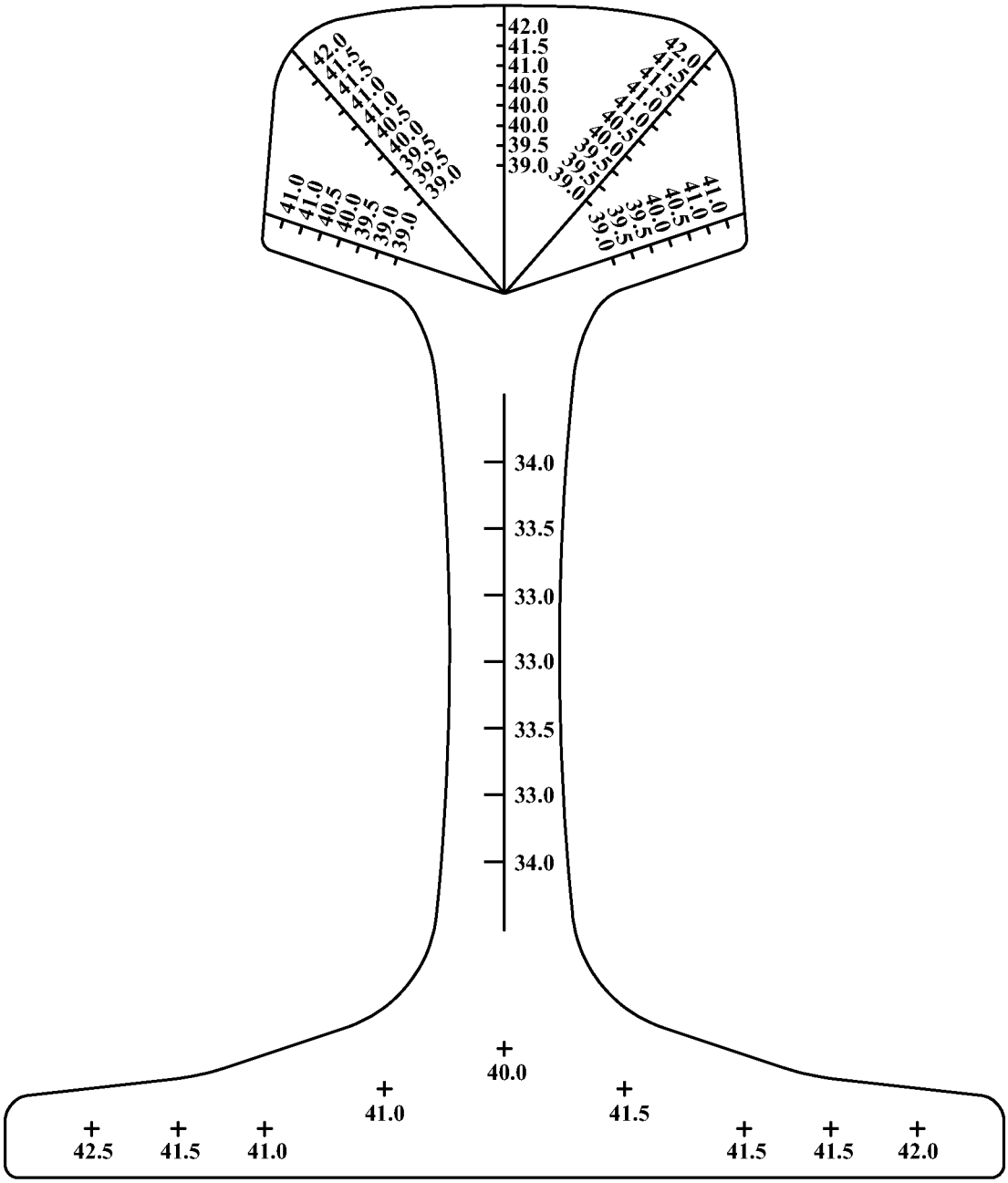
FIG. 1 is a full cross-sectional view of the Rockwell hardness distribution of a steel rail according to an exemplary embodiment of the invention.

To further illustrate the invention, experiments detailing the high carbon content and high strength heat-treated steel rail with excellent wear resistance and plasticity as well as a method for producing the same are described below. It should be noted that the following examples are intended to describe and not to limit the invention.

A high carbon content and high strength heat-treated steel rail is produced by accelerated cooling. The steel rail has excellent wear resistance and plasticity, and comprises, by weight, aside from iron and irremovable impurities, 0.80-1.20% carbon, 0.20-1.20% silicon, 0.20-1.60% manganese, 0.15-1.20% chromium, 0.01-0.20% vanadium, 0.002-0.050% titanium, less than or equal to 0.030% phosphorus, less than or equal to 0.030% sulfur, less than or equal to 0.010% aluminum, less than or equal to 0.0100% nitrogen.

C is an element that is effective for accelerating the pearlitic transformation and for securing wear resistance. Furthermore, it is the most effective and economic element for improving the strength, hardness, and wear resistance of steel rails. The carbon content of a steel rail is reported by weight, i.e., 0.80-1.20%. If the content is 0.80% or less, the density of the cementite phases in the pearlite structures may be insufficient to improve the wear resistance. Thus, the wear resistance of such steel rails cannot be enhanced greatly. If the carbon content exceeds 1.20%, even if heat treatment is adopted, the precipitation of pro-eutectoid cementite structures, from the surface of the steel rail to a depth of 25 mm, cannot be prevented. The toughness and plasticity of such a steel rail will deteriorate, or fatigue sources will form, both of which significantly reduce the service life of the steel rail. For these reasons, the carbon content is limited to within the range from 0.80 to 1.20%.

Si is an element that induces formation of ferrite. In pearlite structures, Si does not dissolve in the cementite, although all phases dissolve in the ferrite matrix. During the transformation from austenite to pearlite, during nucleation and growth of the cementite, Si is excluded. That is to say, Si inhibits formation of the cementite, promotes generation of the ferrite, and improves the upper limit of the C content in a steel rail while inhibiting pro-eutectoid cementite structure formation. Si is a solid that dissolves in the ferrite phase. The solid solution strengthening effects enhance the rail hardness. However, if the Si content is less than 0.20%, such effects are not expected. On the other hand, if the Si content exceeds 1.20%, a large fraction of surface defects form during the hot rolling process. In that case, the steel rail becomes brittle, crack growth is accelerated, and the solderability thereof decreases. For these reasons, the Si content is limited to within the range from 0.20 to 1.20%.

Mn is a solid solution strengthening element that improves the hardness and strength of the rail, decreases the pearlite transformation temperature, and decreases the pearlite lamellar spacing. Thus, Mn indirectly improves the toughness and plasticity of rails. Furthermore, it prevents formation of the pro-eutectoid cementite and reacts with S to yield MnS, thereby reducing the damage caused by S. However, if the Mn content is less than 0.20%, these effects are not expected. On the other hand, if the Mn content exceeds 1.60%, the toughness of the rail is damaged, the critical cooling rate for producing martensite structures is significantly decreased, and, together with phase segregation effects during the production process, abnormal structures, such as martensite and bainite, form, which easily cause the rail to break. For these reasons, the amount of Mn is limited to within the range from 0.20 to 1.60%.

Similar to Mn, Cr is also a solid solution strengthening element that improves the hardness and strength of the rail, decreases the pearlite transformation temperature, and decreases the pearlite lamellar spacing. Furthermore, Cr replaces the iron atoms of the cementite ($Fe_3C$) to yield an alloy cementite. Thus, the cementite is strengthened, thereby improving the wear resistance of the rail in use. If the content of Cr is less than 0.15%, the strength improvement of the rail is not great. However, if the content of Cr exceeds 1.20%, the critical cooling rate for producing martensite structures decreases significantly, and, thus, abnormal structures, such as martensite and bainite, form, which easily cause the rail to break. For these reasons, the amount of Cr is limited to within the range from 0.15 to 1.20%.

V is a precipitation strengthening element that improves the hardness and strength of the rail by reacting with C and N during the process of cooling the hot-rolled rail to yield a $V(C.N)_x$ precipitate. Upon heating and welding of the rail, V prevents the growth of austenite grains and makes the grains fine so that the strength, ductility, toughness, and wear resistance of the rail are greatly enhanced. Upon transformation from austenite to pearlite, $V(C.N)_x$ precipitates first, so that the carbon content of the austenite decreases, thereby accelerating formation of a low-carbon content ferrite. When V binds to Si, formation of cementite is greatly inhibited. In particular, a high carbon content prevents the precipitation of detrimental pro-eutectoid cementite. However, if the V content is less than 0.01%, these effects are not expected. On the other hand, if the content exceeds 0.20%, the effect is saturated. For these reasons, the amount of V is limited to within the range from 0.01 to 0.20%.

Ti is a precipitation strengthening element that binds to C and N to produce a precipitate that reduces damages to the rail caused by free N. The precipitate has a high melting point and precipitates during the process of cooling of the liquid steel and hot rolling of the austenite structures, so that growth of the austenite grains is inhibited and the grains are fine. The refinement of grains during the process of hot welding greatly improves the toughness of welded joints. However, if the Ti content is less than 0.002%, these effects are not expected. On the other hand, if the content exceeds 0.050%, the effects are saturated. For these reasons, the amount of Ti is limited to within the range 0.020-0.050%.

P is an element that not only strengthens ferrite, improves the hardness of the pearlite structures, and improves the atmospheric corrosion resistance of the steel rail, but also improves the low-temperature brittle transition temperature and accelerates generation of the pro-eutectoid cementite. Thus, P greatly reduces the low-temperature impact properties of the rail and increases the content of pro-eutectoid cementite. For these reasons, the content of P is limited to 0.030% or less.

S is an element that easily causes phase segregation and mainly binds to Mn to yield MnS. If the S content exceeds 0.030%, the phase segregation of Mn is greatly improved, thereby accelerating formation of the pro-eutectoid cementite and reducing the toughness and plasticity of the rail. For these reasons, the content of S is limited to 0.030% or less.

Al is an element that inhibits the formation of pro-eutectoid cementite. Furthermore, it reacts with oxygen to yield $Al_2O_3$, which provides a hard inclusion and generally develops into a fatigue source. To improve the fatigue properties of the rail and reduce the hard inclusion content, the content of Al should be strictly controlled. For these reasons, the content of Al is limited to 0.010% or less.

N is harmful to rail properties, and the harm increases with increasing carbon content. Thus, the lower the N content, the better the rail properties. N mainly originates from alloys or air doping during the process of rail production. For high carbon content hypereutectoid rails, the N content is controlled at 0.0100% or less. To reduce the harm caused by N, Ti is introduced. If the content of N is less than or equal to 0.0070%, the Ti content is between 0.002% and 0.020%; if the N content exceeds 0.0070% and is less than or equal to 0.010%, the Ti content is between 0.010% and 0.050%.

Preferably, the steel rail comprises, by weight, 0.80-1.20% carbon, 0.20-1.20% silicon, 0.40-1.20% manganese, 0.15-0.60% chromium, 0.01-0.15% vanadium, 0.002-0.030% titanium, less than or equal to 0.030% phosphorus, less than or equal to 0.030% sulfur, less than or equal to 0.010% aluminum, less than or equal to 0.0100% nitrogen, iron, and impurities.

Furthermore, the steel rail comprises, by weight, 0.01-0.50% molybdenum, 0.002-0.050% niobium, 0.10-1.00% nickel, 0.05-0.50% copper, 0.002-0.050% rare earth metal, 0.0001-0.1000% zirconium, or a mixture thereof.

Mo is an element that decreases the pearlite transformation temperature and decreases the pearlite lamellar spacing. Thus, Mo improves the hardness, strength, and wear-resistance of the rail. However, if the content of Mo is less than 0.01%, these effects are not expected. On the other hand, if the content exceeds 0.50%, the critical cooling rate for producing martensite structures is significantly decreased and detrimental martensite structures form. For these reasons, the amount of Mo is limited to within the range from 0.01 to 0.50%.

Similar to V, Nb easily forms a carbonitride thereof and, thus, makes the austenite fine-grained. In contrast with V, Nb prevents the growth of austenite grains under much higher temperatures, thereby improving the ductility, toughness, and wear resistance of the rail. Upon heating and welding the rail, V further prevents the growth of austenite grains and makes the grains fine so that the strength, ductility, toughness, and wear resistance of the rail can be greatly enhanced. However, if the Nb content is less than 0.002%, these effects are not expected. On the other hand, if the content exceeds 0.050%, the effects are saturated. For these reasons, the amount of Nb is limited to within the range from 0.002 to 0.050%.

Ni is a solid that dissolves in the rail and improves the hardness, strength, and toughness of the rail, particularly the low-temperature toughness. Thus, the wear resistance of the rail and low temperature toughness of the welded joints are enhanced. However, if the content of Ni is less than 0.10%, these effects are not expected. On the other hand, if the content exceeds 0.10%, the effects are saturated. For these reasons, the amount of Ni is limited to within the range from 0.10 to 1.00%.

Cu is an element that improves the corrosion resistance, hardness, strength, and wear resistance of the rail. However, if the Cu content is less than 0.05%, these effects are not expected. On the other hand, if the content exceeds 0.50%, the effects are saturated, and, upon improper heating, copper brittleness occurs. For these reasons, the Cu content is limited to within the range from 0.05 to 0.50%.

Re purifies the rails and improves the wear and corrosion resistance thereof. Furthermore, Re prevents the accumulation of hydrogen and the generation of hydrogen-induced cracking (white spots). The addition of Re alters the distribution of impurities, reduces the damages caused by S, As, Sb, etc., and improves the fatigue properties of the rail. However, if the Re content is less than 0.002%, these effects are not expected. On the other hand, if the content exceeds 0.050%, the impurity content is high and, thus, the rail properties deteriorate. For these reasons, the Re content is limited to within the range from 0.002 to 0.050%.

Zirconium oxide ($ZrO_2$) easily forms a nucleation point during the early solidification stages of high carbon content steel. It improves the equiaxed grain area of the slab and reduces the phase segregation of elements in the center thereof. Furthermore, $ZrO_2$ inhibits formation of the pro-eutectoid cementite structures. However, if the content of Zr is less than 0.0001%, these effects are not expected. On the other hand, if the content exceeds 0.1000%, a large number of crude impurities form, which, similar to $Al_2O_3$, generally develop into fatigue sources and reduce the service life of the rail. For these reasons, the amount of Zr is limited to within the range from 0.0001 to 0.1000%.

Studies show that if the total weight percent of Cr+1.5Mn+6Mo+4Nb is less than 1.0%, the strengthening effects are not good, and the hardness of the resultant steel rail is not high. If the total weight percent of Cr+1.5Mn+6Mo+4Nb exceeds 2.5%, the critical cooling rate for producing martensite structures decreases significantly, and the amount of pro-eutectoid cementite structures increases. Thus, upon heat treatment, detrimental martensite and bainite structures form, and pro-eutectoid cementite structure generation cannot be absolutely prevented by a later thickness to a depth of 25 mm from the surface. The toughness and fatigue properties of the rail are thereby significantly reduced. For these reasons, the amount of Cr+1.5Mn+6Mo+4Nb is limited to within the range from 1.0 to 2.5 wt. %. To prevent the phase segregation of Mn and Cr and the formation of martensite, which is harmful to the rail, a Si content in excess of 0.20% is added.

The following explain the reasons why steel rails are treated according to the method of the invention.

1. Reasons for Limiting the Maximum Heating Temperature.

Hypereutectoid rails have a high carbon content, low melting point, and slow heat conductivity. When the hypereutectoid rails are heated under a heating rate and maximum heating temperature suitable for common rails, the phase segregation regions of the solidification structure of the rail surface partially melt, and cracks propagate during the process of rolling and straightening, thereby producing breaks in the rails. Statistics show that higher carbon content and higher heating temperatures facilitate the formation of cracks, and rolled steel includes large austenite grains that reduce the roughness and plasticity of the rails. Thus, the carbon content and maximum heating temperature must be strictly controlled. Studies have identified the relationship between the maximum heating temperature required for melting a slab and the carbon content thereof. This relationship can be represented by the following formula: Tmax=1400−100[% C]. The carbon content represents the carbon content of a slab and is calculated by weight. [% C] represents the carbon content (wt. %) of the slab, and is multiplied by 100, i.e., if the carbon content is m % (where m represents the numerical fraction, by weight, of carbon), Tmax=1,400−100×m. For example, if the carbon content is 0.9%, the heating temperature Tmax=1,400−100×0.9=1,310° C.

Controlling the maximum heating temperature according to the carbon content of the rail slab prevents the hypereutectoid rails from melting, the rails do not form cracks, and the austenite grains are fine. These properties improve the toughness and plasticity of the rail.

2. Reasons for Limiting the Incubation Time at the Heating Temperature.

Compared with common rails with 0.80% carbon content, hypereutectoid rails have a high carbon content and, thus, a low toughness and plasticity. Therefore, the safety of the rails during use may be improved by enhancing the toughness and plasticity of the hypereutectoid rails. For a rail with certain compositions, a good method for improving the toughness and plasticity is by reducing the austenite grain size of the finishing rail. Decreasing the heating temperature and the holding time thereof during heating of the slab reduces the initial austenite grain size prior to rolling, thereby further reducing the austenite grain size of the finishing rail. Decreasing the heating time reduces the thickness of the decarburization layer on the rail surface, thereby increasing the wear resistance and fatigue properties of the rail. Studies show that at heating temperatures exceeding 1,050° C., the relationship between the maximum holding time of a heating temperature and the carbon content can be represented by the following formula: Hmax=700−260[% C]. [% C] represents the carbon content (wt. %) of the slab, which is multiplied by 100, i.e., when the carbon content is m % (where m represents the numerical fraction, by weight, of carbon), Hmax=700−260×m. For example, when the carbon content is 0.9%, the holding time Hmax=700−260×0.9=466° C.

The formula does not determine a minimum time. To secure a uniform sectional temperature and a smooth rolling of the hypereutectoid steel slab, the heating time at temperatures exceeding 1050° C. generally exceeds 120 min.

3. Reasons for Limiting the Finish Rolling Deformation and Finishing Temperature.

Aside from the heating temperature and the incubation time thereof, the finish rolling deformation and finishing temperature influence the austenite structures. If the final reduction of area is less than 5%, the austenite structures cannot be recrystallized, the austenite grain size is difficult to reduce, and the resultant pearlite structures are crude and large. If the reduction of area of the finishing rail exceeds 13%, the large deformations prevent determination of the dimensional accuracy of the rail section. Thus, to reduce the austenite grain size, improve the toughness and plasticity, and secure the dimensional accuracy of the rail section, the final reduction of area must be controlled within 5-13%.

A finishing temperature for the rail of less than 850° C. is conducive to the formation of fine austenite grain sizes. However, during rolling, the deformation resistance and roll wear increase, and cracks occur in the rail base. If the finishing temperature exceeds 980° C., the austenite structures of the finishing rail are crude and large. The resultant pearlite structures are also large, which reduces the toughness and plasticity of the rail. Thus, the finishing temperature of the hypereutectoid rail must be controlled within 850-980° C.

4. Reasons for Limiting the Heat Treatment Process.

For hypereutectoid rails with residual heat, the temperature of transformation from the austenite structures to the pearlite structures under air cooling conditions is about 650° C. However, the precipitation temperature of the proeutectoid cementite structures is 680° C. Thus, if the temperature prior to accelerated cooling is less than 680° C., the proeutectoid cementite precipitates on the rail surface, and, thus the proeutectoid cementite may be present at the rail surface to a depth of 25 mm. If the temperature exceeds 900° C., the final temperature after cooling is still high, and, thus, the railhead core does not undergo a phase transition, or the transition is incomplete. Consequently, the resultant pearlite lamellar spacing during air cooling is large, and a large quantity of proeutectoid cementite precipitates. Thus, the thickness of the hardened layer of the rail decreases, and the proeutectoid cementite may be present from the rail surface to a depth of 25 mm. For these reasons, the temperature prior to accelerated cooling must be controlled within 680-900° C.

Accelerated cooling of the rails with a residual temperature of 680-900° C. increases the degree of supercooling during transformation from the austenite structures to the pearlite structures. Thus, the obtained pearlite structures have a small lamellar spacing, the precipitate of the proeutectoid cementite is inhibited, and the rails have a high strength and hardness. If the cooling rate is less than 1.5° C./s, the rail has low strength, the tensile strength is not guaranteed to be 1,330 MPa or above, and the proeutectoid cementite may precipitate from the rail surface to a depth of 25 mm. If the cooling rate exceeds 10° C./s, the rail strength cannot be further enhanced, and martensite and bainite structures are present at the segregation regions and at the surface. For these reasons, the accelerated cooling rate is controlled at 1.5-10° C./s, and cooling is terminated at 400-500° C. Furthermore, studies show that increasing the carbon content of the rail enhances the accelerated cooling rate. If the carbon content is less than 0.88% and is cooled at a cooling rate of 1.5° C./s, no proeutectoid cementite precipitates. If the carbon content exceeds 1.00%, the cooling rate should exceed 3.0° C./s so that no proeutectoid cementite precipitates from the rail surface to a depth of 25 mm. The cooling effects are achieved using spraying and compressed air as a cooling agent by controlling the ratio and flow of the hydrated air.

During use, rails support train wheels and bend elastically. The railhead and rail base are the components under maximum stress, and the rail web forms a neutral component that shoulders small stresses. If the railhead is cooled while the base is not, a large quantity of proeutectoid cementite precipitates from the base, thereby reducing the fatigue properties of the base. Cooling of the rail web has no obvious effects on the performance of the rail system. Thus, the railhead and base should be cooled to improve the rail properties.

Example

A steel rail is produced following the chemical compositions described in Table 1 and the method described in Table 2. The steel rails of the invention are numbered Nos. 1-13, and those for comparison are numbered as Nos. 14-15.

TABLE 1

| | | Compositions (wt. %) | | | | | | | | | | | |
|---|---|---|---|---|---|---|---|---|---|---|---|---|---|
| Steel rail | No. | C | Si | Mn | P | S | Cr | V | Al | N | Ti | Other elements | Cr + 1.5Mn + 6Mo + 4Nb |
| Steel rails of the invention | 1 | 0.80 | 0.53 | 0.60 | 0.013 | 0.006 | 0.17 | 0.03 | 0.005 | 0.0050 | 0.007 | | 1.07 |
| | 2 | 0.83 | 0.61 | 1.20 | 0.015 | 0.008 | 0.58 | 0.06 | 0.005 | 0.0051 | 0.005 | | 2.38 |
| | 3 | 0.88 | 0.78 | 0.95 | 0.014 | 0.026 | 0.35 | 0.04 | 0.007 | 0.0063 | 0.009 | Mo: 0.05 | 2.08 |
| | 4 | 0.91 | 1.10 | 1.10 | 0.008 | 0.006 | 0.22 | 0.02 | 0.004 | 0.0073 | 0.015 | Nb: 0.008 | 1.91 |
| | 5 | 0.93 | 0.63 | 0.82 | 0.018 | 0.012 | 0.42 | 0.05 | 0.005 | 0.0065 | 0.011 | | 1.65 |
| | 6 | 0.97 | 0.93 | 0.77 | 0.010 | 0.014 | 0.39 | 0.08 | 0.006 | 0.0088 | 0.018 | Cu: 0.23<br>Ni: 0.09 | 1.55 |
| | 7 | 0.98 | 0.45 | 0.45 | 0.017 | 0.016 | 0.41 | 0.03 | 0.009 | 0.0095 | 0.022 | Re: 0.021 | 1.09 |
| | 8 | 1.03 | 0.32 | 0.61 | 0.025 | 0.004 | 0.30 | 0.10 | 0.008 | 0.0081 | 0.014 | | 1.22 |
| | 9 | 1.05 | 0.56 | 0.75 | 0.010 | 0.011 | 0.25 | 0.04 | 0.004 | 0.0085 | 0.016 | Zr: 0.0050 | 1.38 |
| | 10 | 1.09 | 0.39 | 0.67 | 0.013 | 0.010 | 0.17 | 0.07 | 0.005 | 0.0083 | 0.015 | | 1.18 |
| | 11 | 1.13 | 0.47 | 0.81 | 0.009 | 0.003 | 0.23 | 0.05 | 0.004 | 0.0089 | 0.013 | | 1.45 |
| | 12 | 1.17 | 0.51 | 0.63 | 0.006 | 0.005 | 0.22 | 0.02 | 0.006 | 0.0089 | 0.016 | | 1.17 |
| | 13 | 1.19 | 0.53 | 0.68 | 0.011 | 0.012 | 0.20 | 0.04 | 0.004 | 0.0098 | 0.021 | | 1.22 |
| Steel rails for comparison | 14 | 0.71 | 0.26 | 1.29 | 0.019 | 0.016 | — | — | — | — | — | | 1.94 |
| | 15 | 0.95 | 0.55 | 0.98 | 0.011 | 0.008 | 0.23 | — | — | — | — | | 1.70 |

TABLE 2

| Steel rails | No. | Heating and rolling conditions | Cooling rate of railheads (° C./S) | Finishing cooling temperature (° C.) |
|---|---|---|---|---|
| Steel rails of the invention | 1 | Maximum heating temperature: 1270° C.;<br>Holding time: 170 min;<br>Finishing temperature: 930° C.;<br>Finishing reduction of area: 8% | 1.5 | 500 |
| | 2 | Maximum heating temperature: 1310° C.;<br>Holding time: 160 min;<br>Finishing temperature: 950° C.;<br>Finishing reduction of area: 9% | 2.7 | 450 |
| | 3 | Maximum heating temperature: 1300° C.;<br>Holding time: 210 min;<br>Finishing temperature: 970° C.;<br>Finishing reduction of area: 7% | 3.1 | 440 |
| | 4 | Maximum heating temperature: 1290° C.;<br>Holding time: 180 min;<br>Finishing temperature: 930° C.;<br>Finishing reduction of area: 9% | 4.2 | 490 |
| | 5 | Maximum heating temperature: 1290° C.;<br>Holding time: 130 min;<br>Finishing temperature: 910° C.;<br>Finishing reduction of area: 6% | 6.3 | 460 |
| | 6 | Maximum heating temperature: 1280° C.;<br>Holding time: 410 min;<br>Finishing temperature: 940° C.;<br>Finishing reduction of area: 12% | 6.5 | 430 |
| | 7 | Maximum heating temperature: 1280° C.;<br>Holding time: 280 min;<br>Finishing temperature: 930° C.;<br>Finishing reduction of area: 11% | 7.4 | 420 |

TABLE 2-continued

| Steel rails | No. | Heating and rolling conditions | Cooling rate of railheads (° C./S) | Finishing cooling temperature (° C.) |
|---|---|---|---|---|
| | 8 | Maximum heating temperature: 1270° C.; Holding time: 320 min; Finishing temperature: 940° C.; Finishing reduction of area: 13% | 5.6 | 450 |
| | 9 | Maximum heating temperature: 1270° C.; Holding time: 230 min; Finishing temperature: 900° C.; Finishing reduction of area: 10% | 5.4 | 490 |
| | 10 | Maximum heating temperature: 1260° C.; Holding time: 200 min; Finishing temperature: 890° C.; Finishing reduction of area: 11% | 2.7 | 470 |
| | 11 | Maximum heating temperature: 1260° C.; Holding time: 330 min; Finishing temperature: 900° C.; Finishing reduction of area: 8% | 3.1 | 460 |
| | 12 | Maximum heating temperature: 1250° C.; Holding time: 260 min; Finishing temperature: 890° C.; Finishing reduction of area: 8% | 4.2 | 480 |
| | 13 | Maximum heating temperature: 1250° C.; Holding time: 250 min; Finishing temperature: 870° C.; Finishing reduction of area: 8% | 6.3 | 480 |
| Steel rails for comparison | 14 | Maximum heating temperature: 1300° C.; Holding time: 150 min; Finishing temperature: 920° C.; Finishing reduction of area: 8% | Hot rolling | |
| | 15 | Maximum heating temperature: 1280° C.; Holding time: 230 min; Finishing temperature: 1000° C.; Finishing reduction of area: 8% | 0.9 | 480 |

FIG. 1 shows a full cross-sectional view of the Rockwell hardness distribution of the steel rail No. 5.

Figure 2:
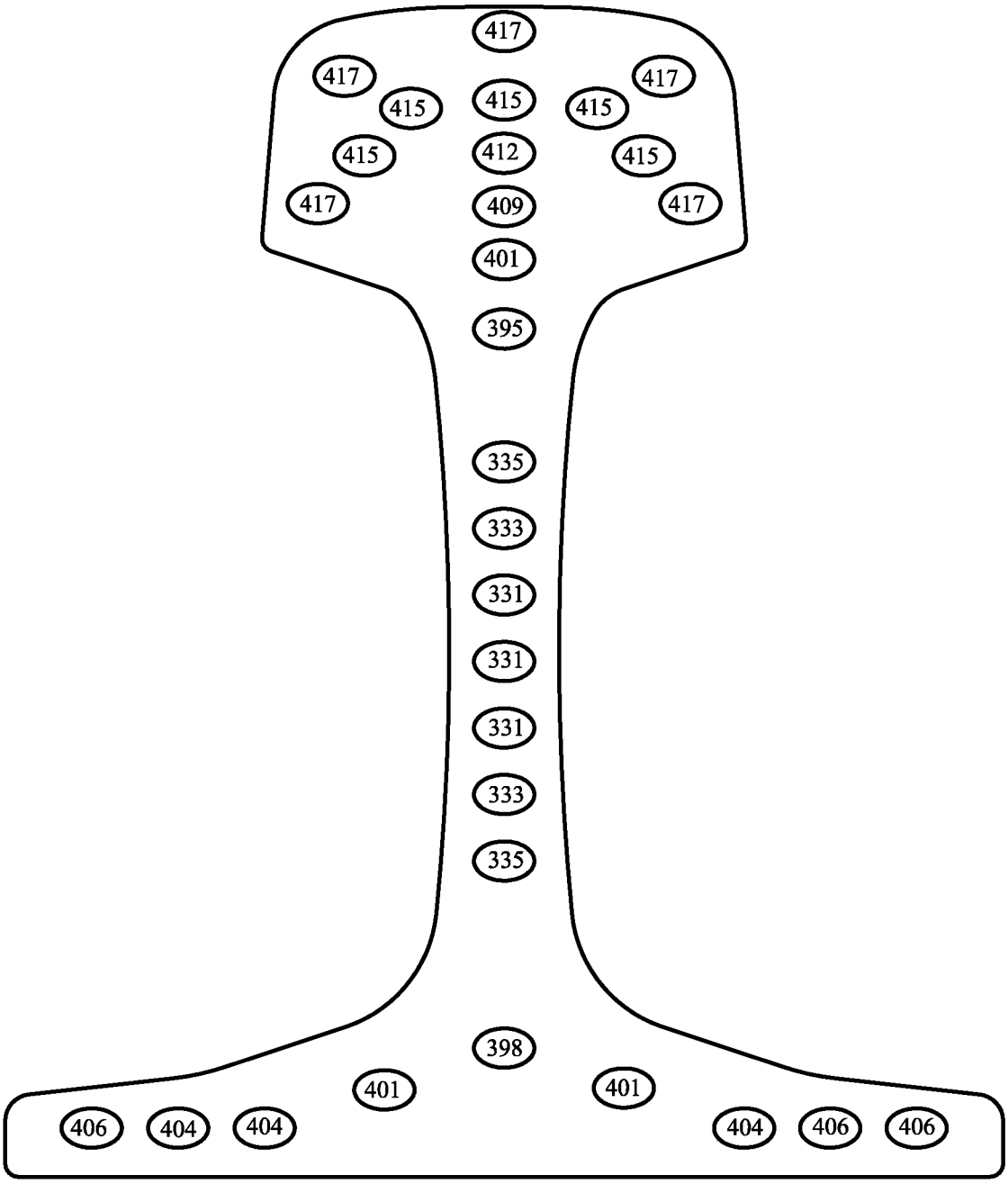
FIG. 2 is a full sectional view of the Brinell hardness distribution of a steel rail according to an exemplary embodiment of the invention.

FIG. 2 shows a full sectional view of the Brinell hardness distribution of the steel rail No. 5.

Figure 3:
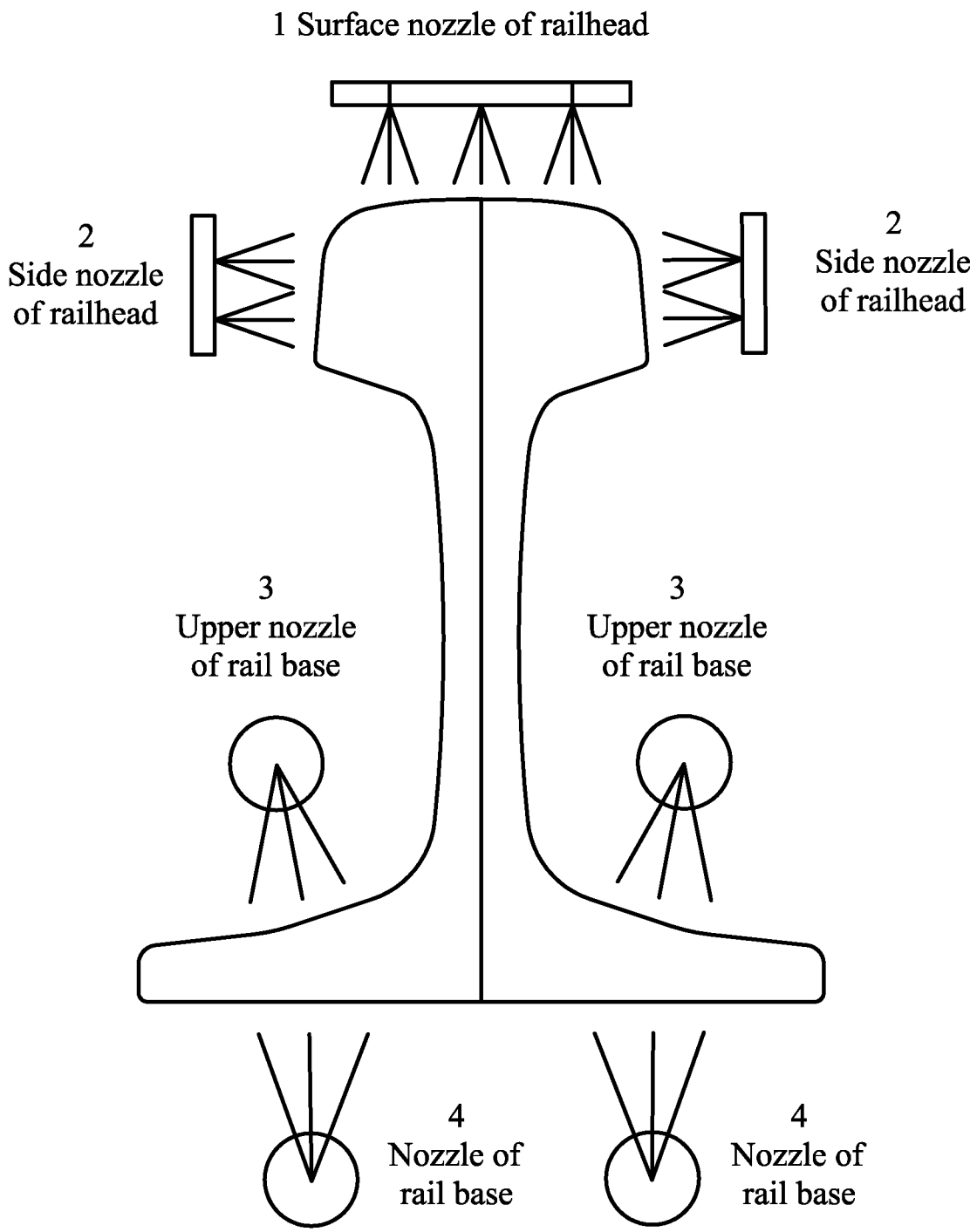
FIG. 3 is a schematic diagram of a cooling mode of a steel rail head and a steel rail base according to one embodiment of the invention.

FIG. 3 shows a cooling mode of the head and base of the steel rail.

Figure 4:
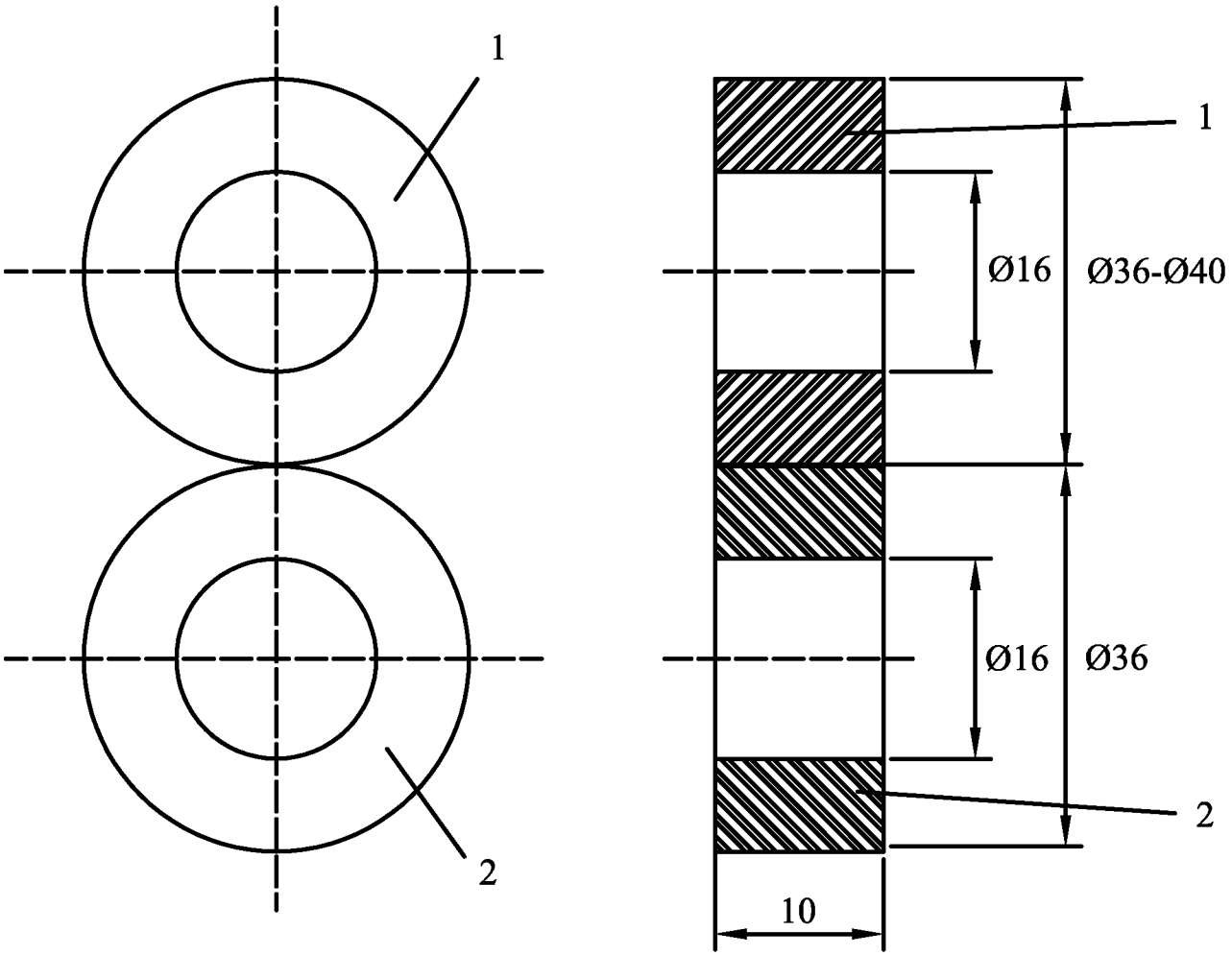
FIG. 4 is a schematic diagram of a wear test carried out on an M-200 abrasion tester according to one embodiment of the invention, wherein 1 represents an upper sample collected from a steel rail head and 2 represents a lower sample for abrasion.

FIG. 4 shows a schematic diagram of a wear test carried out on an M-200 abrasion tester, wherein 1 indicates an upper sample collected from the steel rail head and 2 represents a lower sample for abrasion testing. The lower samples in all tests are composed of the same materials. The test parameters are as follows:

Sample dimension: thickness, 10 mm; diameter, 36 mm; round.

Test load: 150 kg.

Slip: 10%.

Material of the lower sample for abrasion: U75V hot-rolling rail with a hardness of 280-310 HB, which is equivalent to that of a train wheel.

Test environment: in air.

Rotation rate: 200 rpm.

Total wear numbers: 200,000.

After the tests, for each rail, the final austenite grain size (μm), tensile strength (MPa), elongation percentage (%), hardness (HB) of the railhead surface, hardness (HRC) of the upper round corner (3 mm) of the railhead, thickness (mm) of the decarburization layer, abrasion loss (g/200,000 times), and structures were measured. The results are listed in Tables 3 and 4.

TABLE 3

| Steel rails | No. | Final austenite grain size (μm) | Tensile strength (MPa) | Elongation percentage (%) | Hardness of railhead surface (HB) | Hardness of an upper round corner (3 mm) of railhead (HRC) | Thickness of decarburization layer (mm) | Abrasion loss (g/200,000 times) |
|---|---|---|---|---|---|---|---|---|
| Steel rails of the invention | 1 | 50 | 1340 | 14 | 381 | 38.0 | 0.20 | 2.63 |
| | 2 | 55 | 1370 | 13 | 390 | 39.5 | 0.35 | 1.54 |
| | 3 | 45 | 1380 | 12 | 395 | 40.0 | 0.25 | 1.21 |
| | 4 | 35 | 1400 | 11.5 | 406 | 40.5 | 0.20 | 1.05 |
| | 5 | 30 | 1420 | 11 | 412 | 41.0 | 0.20 | 1.03 |
| | 6 | 40 | 1430 | 11 | 417 | 41.5 | 0.40 | 0.94 |
| | 7 | 35 | 1430 | 10.5 | 415 | 41.5 | 0.35 | 0.98 |
| | 8 | 35 | 1440 | 10.5 | 420 | 42.0 | 0.35 | 0.87 |
| | 9 | 30 | 1440 | 10.5 | 426 | 42.5 | 0.25 | 0.81 |
| | 10 | 25 | 1400 | 10.5 | 404 | 41.5 | 0.15 | 0.95 |

TABLE 3-continued

| Steel rails | No. | Final austenite grain size (μm) | Tensile strength (MPa) | Elongation percentage (%) | Hardness of railhead surface (HB) | Hardness of an upper round corner (3 mm) of railhead (HRC) | Thickness of decarburization layer (mm) | Abrasion loss (g/200,000 times) |
|---|---|---|---|---|---|---|---|---|
| | 11 | 30 | 1420 | 10.0 | 415 | 41.5 | 0.25 | 0.91 |
| | 12 | 30 | 1450 | 9.5 | 426 | 42.5 | 0.20 | 0.76 |
| | 13 | 30 | 1470 | 9.5 | 432 | 43.0 | 0.25 | 0.69 |
| Steel rails | 14 | 65 | 970 | 13 | 270 | 27.0 | 0.25 | 5.78 |
| for | 15 | 70 | 1290 | 8 | 373 | 37.0 | 0.30 | 2.87 |
| comparison | | | | | | | | |

TABLE 4

| Steel rails | No. | Structures |
|---|---|---|
| Steel rails of the invention | 1 | Railhead: Pure pearlite structures<br>Rail base: Pure pearlite structures |
| | 2 | Railhead: Pure pearlite structures<br>Rail base: Pure pearlite structures |
| | 3 | Railhead: Pure pearlite structures<br>Rail base: Pure pearlite structures |
| | 4 | Railhead: Pure pearlite structures<br>Rail base: Pure pearlite structures |
| | 5 | Railhead: from the surface down to 30 mm are pearlite structures, and a trace quantity of proeutectoid cementite structures are distributed in other places<br>Rail base: Pure pearlite structures |
| | 6 | Railhead: from the surface down to 30 mm are pearlite structures, and a trace quantity of proeutectoid cementite structures are distributed in other places<br>Rail base: from the surface down to 25 mm are pearlite structures, and a trace quantity of proeutectoid cementite structures are distributed in other places |
| | 7 | Railhead: from the surface down to 28 mm are pearlite structures, and a trace quantity of proeutectoid cementite structures are distributed in other places<br>Rail base: from the surface down to 25 mm are pearlite structures, and a trace quantity of proeutectoid cementite structures are distributed in other places |
| | 8 | Railhead: from the surface down to 27 mm are pearlite structures, and a trace quantity of proeutectoid cementite structures are distributed in other places<br>Rail base: from the surface down to 25 mm are pearlite structures, and a trace quantity of proeutectoid cementite structures are distributed in other places |
| | 9 | Railhead: from the surface down to 25 mm are pearlite structures, and a trace quantity of proeutectoid cementite structures are distributed in other places<br>Rail base: from the surface down to 25 mm are pearlite structures, and a trace quantity of proeutectoid cementite structures are distributed in other places |
| | 10 | Railhead: from the surface down to 25 mm are pearlite structures, and a trace quantity of proeutectoid cementite structures are distributed in other places<br>Rail base: from the surface down to 25 mm are pearlite structures, and a trace quantity of proeutectoid cementite structures are distributed in other places |
| | 11 | Railhead: from the surface down to 25 mm are pearlite structures, and a trace quantity of proeutectoid cementite structures are distributed in other places<br>Rail base: from the surface down to 25 mm are pearlite structures, and a trace quantity of proeutectoid cementite structures are distributed in other places |
| | 12 | Railhead: from the surface down to 25 mm are pearlite structures, and a trace quantity of proeutectoid cementite structures are distributed in other places<br>Rail base: from the surface down to 30 mm are pearlite structures, and a trace quantity of proeutectoid cementite structures are distributed in other places |
| | 13 | Railhead: from the surface down to 25 mm are pearlite structures, and a trace quantity of proeutectoid cementite structures are distributed in other places<br>Rail base: from the surface down to 25 mm are pearlite structures, and a trace quantity of proeutectoid cementite structures are distributed in other places |
| Steel rails for comparison | 14 | Railhead: Pure pearlite structures<br>Rail base: Pure pearlite structures |
| | 15 | Railhead: from the surface down to 10 mm are pearlite structures, and a trace quantity of proeutectoid cementite structures are distributed in other places<br>Rail base: from the surface down to 10 mm are pearlite structures, and a trace quantity of proeutectoid cementite structures are distributed in other places |

As shown in Tables 3 and 4, for the rails of the invention, the tensile strength of the railhead is greater than or equal to 1,330 MPa, the elongation percentage is greater than or equal to 9%, the railhead hardness is greater than or equal to 380 HB, the thickness of the hardened layer exceeds 25 mm, and the fine pearlite structures are distributed at least from the surface of the railhead to a depth of 25 mm. The rail exhibits excellent wear resistance and plasticity and satisfies the requirements for overloading.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

The invention claimed is:

1. A steel rail, comprising by weight 0.80-1.20% carbon, 0.20-1.20% silicon, 0.20-1.60% manganese, 0.15-1.20% chromium, 0.01-0.20% vanadium, 0.002-0.050% titanium, less than or equal to 0.030% phosphorus, less than or equal to 0.030% sulfur, less than or equal to 0.010% aluminum, less than or equal to 0.0100% nitrogen, 0.01-0.50% molybdenum, 0.002-0.050% niobium, 0.10-1.00% nickel, 0.05-0.50% copper, 0.002-0.050% a rare earth metal, 0.0001-0.1000% zirconium, and the balance comprising iron;

wherein:

an elongation percentage of the steel rail is larger than or equal to 9%;

a depth of a hardened layer of the steel rail is larger than or equal to 25 mm;

weight percentage amounts of chromium, manganese, molybdenum, and niobium with respect to a weight of the steel rail satisfy the following relationship:

$$1.0\% \leq wt[Cr]+1.5\times wt[Mn]+6\times wt[Mo]+4\times wt[Nb] \leq 2.5\%,$$

wherein wt[Cr] is a weight percentage amount of chromium with respect to the weight of the steel rail, wt[Mn] is a weight percentage amount of manganese with respect to the weight of the steel rail, wt[Mo] is a weight percentage amount of molybdenum with respect to the weight of the steel rail, and wt[Nb] is a weight percentage amount of niobium with respect to the weight of the steel rail; and a thickness of pure fine pearlite structures of a steel railhead of the steel rail is larger than or equal to 25 mm.

2. The steel rail of claim 1, comprising by weight 0.80-1.20% carbon, 0.20-1.20% silicon, 0.40-1.20% manganese, 0.15-0.60% chromium, 0.01-0.15% vanadium, 0.002-0.030% titanium, less than or equal to 0.030% phosphorus, less than or equal to 0.030% sulfur, less than or equal to 0.010% aluminum, and less than or equal to 0.0100% nitrogen.

3. The steel rail of claim 2, wherein when a nitrogen content of said steel rail is less than or equal to 0.0070%, a titanium content is 0.002-0.020%; when said nitrogen content of said steel rail exceeds 0.0070% but is less than or equal to 0.010%, said titanium content is 0.010-0.050%.

4. The steel rail of claim 2, wherein a tensile strength of a steel railhead is greater than or equal to 1,330 MPa and a hardness thereof is greater than or equal to HB 380.

5. The steel rail of claim 1, wherein when a nitrogen content of said steel rail is less than or equal to 0.0070%, a titanium content is 0.002-0.020%; when said nitrogen content of said steel rail exceeds 0.0070% but is less than or equal to 0.010%, said titanium content is 0.010-0.050%.

6. The steel rail of claim 5, wherein a tensile strength of a steel railhead is greater than or equal to 1,330 MPa and a hardness thereof is greater than or equal to HB 380.

7. The method for producing the steel rail of claim 1, comprising heating a slab to a heating temperature, multi-pass rolling, and accelerated cooling, wherein a maximum heating temperature (° C.) of said slab is equal to 1,400 minus 100[% C], wherein [% C] represents the carbon content (wt. %) of said slab multiplied by 100.

8. The method of claim 7, wherein the heating temperature is greater than or equal to 1,050° C., and a maximum holding time (min) for said temperature is equal to 700 minus 260[% C], wherein [% C] represents the carbon content of said slab multiplied by 100.

9. The method of claim 7, wherein in the process of the multi-pass rolling, a reduction of area of the final pass is 5-13%, and a finishing temperature is 850-980° C.

10. The method of claim 7, wherein the residual heat temperature of hot-rolled steel rail is 680-900° C., and during cooling, a railhead and rail base are cooled using spraying or compressed air to 400-500° C. with a cooling rate of 1.5-10° C./s, and then cooled using natural air.

11. A steel rail, comprising by weight 0.80-1.20% carbon, 0.20-1.20% silicon, 0.20-1.60% manganese, 0.15-1.20% chromium, 0.01-0.20% vanadium, 0.002-0.050% titanium, less than or equal to 0.030% phosphorus, less than or equal to 0.030% sulfur, less than or equal to 0.010% aluminum, less than or equal to 0.0100% nitrogen, 0.01-0.50% molybdenum, 0.002-0.050% niobium, 0.10-1.00% nickel, 0.05-0.50% copper, 0.002-0.050% a rare earth metal, 0.0001-0.1000% zirconium, and the balance comprising iron;

wherein:

an elongation percentage of the steel rail is larger than or equal to 9%;

weight percentage amounts of chromium, manganese, molybdenum, and niobium with respect to a weight of the steel rail satisfy the following relationship:

$$1.0\% \leq wt[Cr]+1.5\times wt[Mn]+6\times wt[Mo]+4\times wt[Nb] \leq 2.5\%,$$

wherein wt[Cr] is a weight percentage amount of chromium with respect to the weight of the steel rail, wt[Mn] is a weight percentage amount of manganese with respect to the weight of the steel rail, wt[Mo] is a weight percentage amount of molybdenum with respect to the weight of the steel rail, and wt[Nb] is a weight percentage amount of niobium with respect to the weight of the steel rail;

a railhead of the steel rail comprises a first surface layer of pure pearlite;

the first surface layer of pure pearlite has a thickness larger than or equal to 25 mm;

a rail base of the steel rail comprises a second surface layer of pure pearlite; and the second surface layer of pure pearlite has a thickness larger than or equal to 25 mm.

12. The steel rail of claim 11, comprising by weight 0.80-1.20% carbon, 0.20-1.20% silicon, 0.40-1.20% manganese, 0.15-0.60% chromium, 0.01-0.15% vanadium, 0.002-0.030% titanium, less than or equal to 0.030% phosphorus, less than or equal to 0.030% sulfur, less than or equal to 0.010% aluminum, and less than or equal to 0.0100% nitrogen.

13. The steel rail of claim 11, wherein a tensile strength of a steel railhead is greater than or equal to 1,330 MPa and a hardness thereof is greater than or equal to HB 380.

14. The steel rail of claim 11, wherein when a nitrogen content of said steel rail is less than or equal to 0.0070%, a titanium content is 0.002-0.020%; when said nitrogen content of said steel rail exceeds 0.0070% but is less than or equal to 0.010%, said titanium content is 0.010-0.050%.

* * * * *